US009822783B2

(12) United States Patent
Tsubokawa

(10) Patent No.: US 9,822,783 B2
(45) Date of Patent: Nov. 21, 2017

(54) VACUUM PUMP

(71) Applicant: SHIMADZU CORPORATION, Kyoto (JP)

(72) Inventor: Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 188 days.

(21) Appl. No.: 14/720,129

(22) Filed: May 22, 2015

(65) Prior Publication Data

US 2015/0345499 A1 Dec. 3, 2015

(30) Foreign Application Priority Data

Jun. 3, 2014 (JP) ..... 2014-114997

(51) Int. Cl.

| | |
|---|---|
| ***F04D 29/58*** | (2006.01) |
| ***F04D 19/04*** | (2006.01) |
| ***F04D 29/08*** | (2006.01) |
| ***F04D 29/52*** | (2006.01) |
| *F04D 29/058* | (2006.01) |
| *F04D 29/059* | (2006.01) |

(52) U.S. Cl.

CPC ..... *F04D 19/042* (2013.01); *F04D 29/083* (2013.01); *F04D 29/522* (2013.01); *F04D 29/584* (2013.01); *F04D 29/5853* (2013.01); *F04D 29/058* (2013.01); *F04D 29/059* (2013.01)

(58) Field of Classification Search

CPC .. F04D 19/042; F04D 19/044; F04D 29/5853; F04D 29/584

See application file for complete search history.

(56) References Cited

U.S. PATENT DOCUMENTS

| | | | | |
|---|---|---|---|---|
| 5,924,841 | A | 7/1999 | Okamura et al. | |
| 6,793,466 | B2 * | 9/2004 | Miyamoto | F04D 19/04 415/177 |
| 2016/0025096 | A1 * | 1/2016 | Shi | F04D 19/042 417/423.1 |

FOREIGN PATENT DOCUMENTS

| | | |
|---|---|---|
| CN | 104870825 | 8/2015 |
| JP | 09-072293 | 3/1997 |

OTHER PUBLICATIONS

Office Action for corresponding application CN 201510181590.7 dated Jun. 1, 2017. English language translation.

* cited by examiner

*Primary Examiner* — Justin Seabe

(74) *Attorney, Agent, or Firm* — Renner Otto Boisselle & Sklar

(57) ABSTRACT

A vacuum pump comprises a cylindrical rotor; a cylindrical stator which discharges gas in cooperation with the rotor; a base housing at least a part of the stator and having a through hole formed at a position facing an outer periphery of the stator; a heating member passing through the through hole from an atmosphere side to a vacuum side to have thermal contact with an outer peripheral surface of the stator to heat the stator; and an axial seal member which vacuum-seals a gap between the through hole and the heating member.

6 Claims, 9 Drawing Sheets

VACUUM PUMP

BACKGROUND OF THE INVENTION

1. Field of the Invention

The present invention relates to a vacuum pump in which the temperature of a stator becomes higher than the temperature of a rotor.

2. Description of the Related Art

Conventionally, there has been used a vacuum pump such as a turbo-molecular pump for chamber evacuation in a semiconductor manufacturing apparatus, a liquid crystal manufacturing apparatus, or the like. In recent years, in an etching process performed by a semiconductor manufacturing apparatus or a liquid crystal manufacturing apparatus, an increase in the amount of reaction products adhered to a vacuum pump has been causing problems such as an increase of troubles of contact between a rotor of the vacuum pump and reaction products and requirement of an overhaul within a short period of time after starting the operation of the apparatus. Thus, there has been a need to make the temperature inside the pump (the temperature of a gas contact part) considerably higher than a conventional temperature to suppress adhesion of reaction products.

A method as disclosed in JP 09-072293 A is known as a method of increasing the temperature inside a pump. In the technique disclosed in JP 09-072293 A, a heating target member which is arranged to face the outer periphery of a rotor is directly heated.

However, in JP 09-072293 A, one end of a heating unit is fixed to the heating target member, and the other end thereof is fixed to abase. Thus, when the heating target member expands by heating, the expansion of the heating target member is disturbed in a part of the heating target member to which the end of the heating unit is fixed, and an unnatural stress is generated in the heating target member. Further, the temperature of the rotor also increases along with an increase in the temperature of the heating target member. Thus, the rotor thermally expands toward the outer peripheral side (toward the heating target member). On the other hand, since the thermal expansion of the heating target member toward the outer peripheral side is disturbed in the part to which the end of the heating unit is fixed, a gap between the rotor and the heating target member becomes smaller, which may cause contact between the rotor and the heating target member.

SUMMARY OF THE INVENTION

A vacuum pump comprises: a cylindrical rotor; a cylindrical stator which discharges gas in cooperation with the rotor; a base housing at least a part of the stator and having a through hole formed at a position facing an outer periphery of the stator; a heating member passing through the through hole from an atmosphere side to a vacuum side to have thermal contact with an outer peripheral surface of the stator to heat the stator; and an axial seal member which vacuum-seals a gap between the through hole and the heating member.

The heating member is disposed with a gap with respect to the through hole of the base and fixed to the stator in a concentric state with the through hole.

Pin holes are formed on the heating member and the base, and positioning pins for achieving the concentric state are inserted into the pin holes.

The vacuum pump further comprises a restriction member restricting movement of the heating member toward the atmospheric side when the fixing is released.

The heating member includes an exhaust pipe discharging sucked gas therethrough and a heater attached to the exhaust pipe, the exhaust pipe passes through the through hole of the base, and has one end having thermal contact with the outer peripheral surface of the stator and the other end exposed to the atmospheric side, and the axial seal member vacuum-seals a gap between the through hole and the exhaust pipe.

The present invention makes it possible to improve the reliability at the time of heating the stator.

DETAILED DESCRIPTION OF PREFERRED EMBODIMENTS

Figure 1:
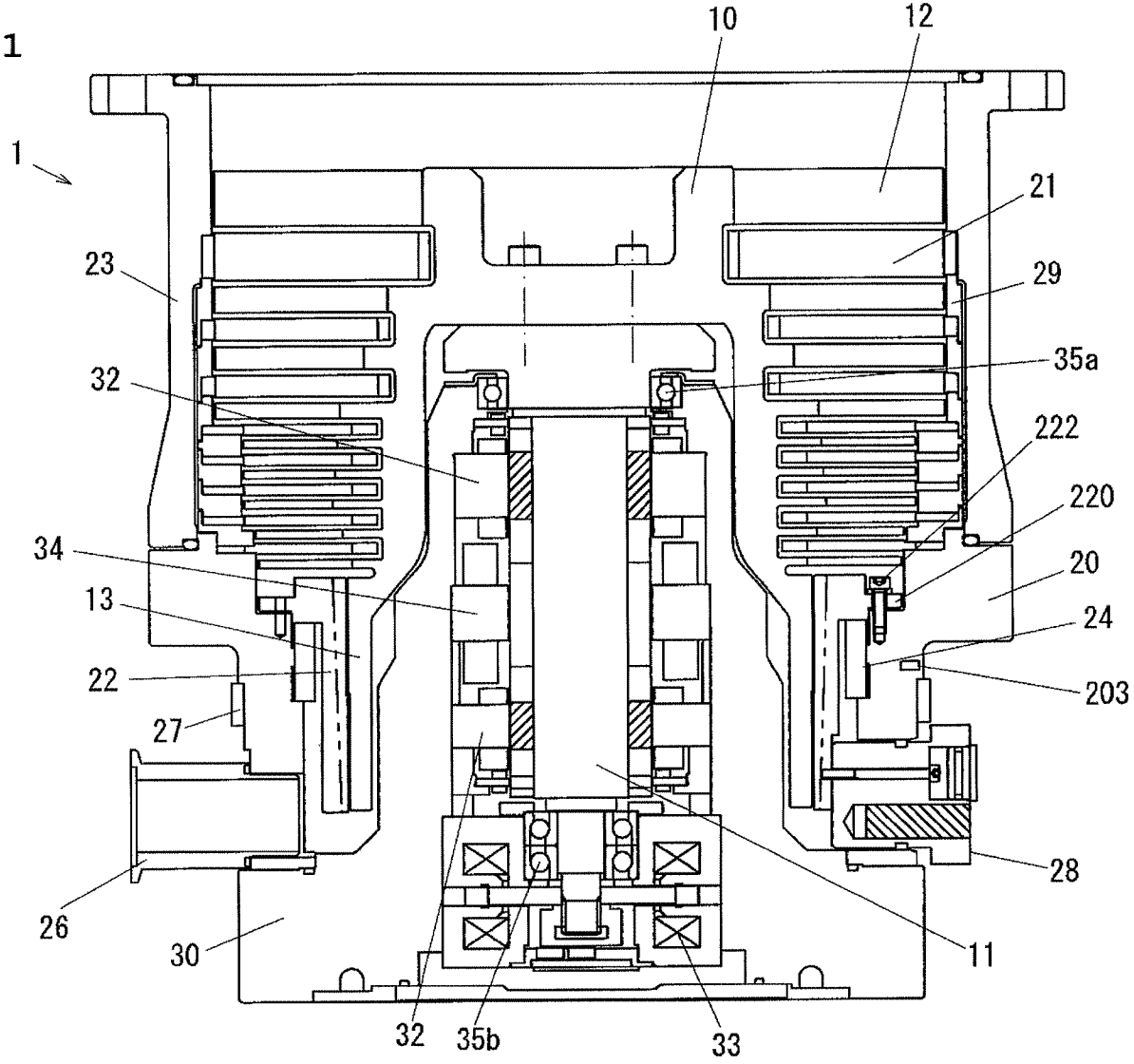
FIG. 1 is a diagram showing an embodiment of a vacuum pump according to the present invention, specifically, showing the cross section of a turbo-molecular pump.

Hereinafter, an embodiment of the present invention will be described with reference to the drawings. FIG. 1 is a diagram showing an embodiment of a vacuum pump according to the present invention, specifically, showing the cross section of a turbo-molecular pump. The turbo-molecular pump 1 is provided with a rotor 10 which includes a plurality of stages of rotor blades 12 and a rotor cylindrical section 13 formed thereon. A plurality of stages of stationary blades 21 are arranged to be stacked corresponding to the plurality of stages of rotor blades 12 inside a pump casing 23. The plurality of stages of stationary blades 21 stacked in the pump axial direction are arranged on a base 20 with spacers 29 interposed therebetween, respectively. The rotor blades 12 include a plurality of turbine blades arranged in the circumferential direction, and the stationary blades 21 include a plurality of turbine blades arranged in the circumferential direction.

A cylindrical stator 22 is arranged on the outer peripheral side of the rotor cylindrical section 13 with a gap interposed therebetween. The stator 22 is fixed to the base 20 with bolts. A screw groove is formed on either the outer peripheral surface of the rotor cylindrical section 13 or the inner peripheral surface of the stator 22. The rotor cylindrical section 13 and the stator 22 together constitute a screw groove pump unit. Gas molecules discharged by the rotor blades 12 and the stationary blades 21 are further compressed by the screw groove pump unit and eventually discharged through an exhaust pipe 26 provided on the base 20.

A rotor shaft 11 is fixed to the rotor 10. The rotor shaft 11 is supported by a radial magnetic bearing 32 and an axial magnetic bearing 33 and driven to rotate by a motor 34. The rotor shaft 11 is supported by mechanical bearings 35*a*, 35*b* when the magnetic bearings 32, 33 are not operating. The radial magnetic bearing 32, the axial magnetic bearing 33, the motor 34, and the mechanical bearing 35*b* are housed in a housing 30 which is fixed to the base 20.

Figure 2:
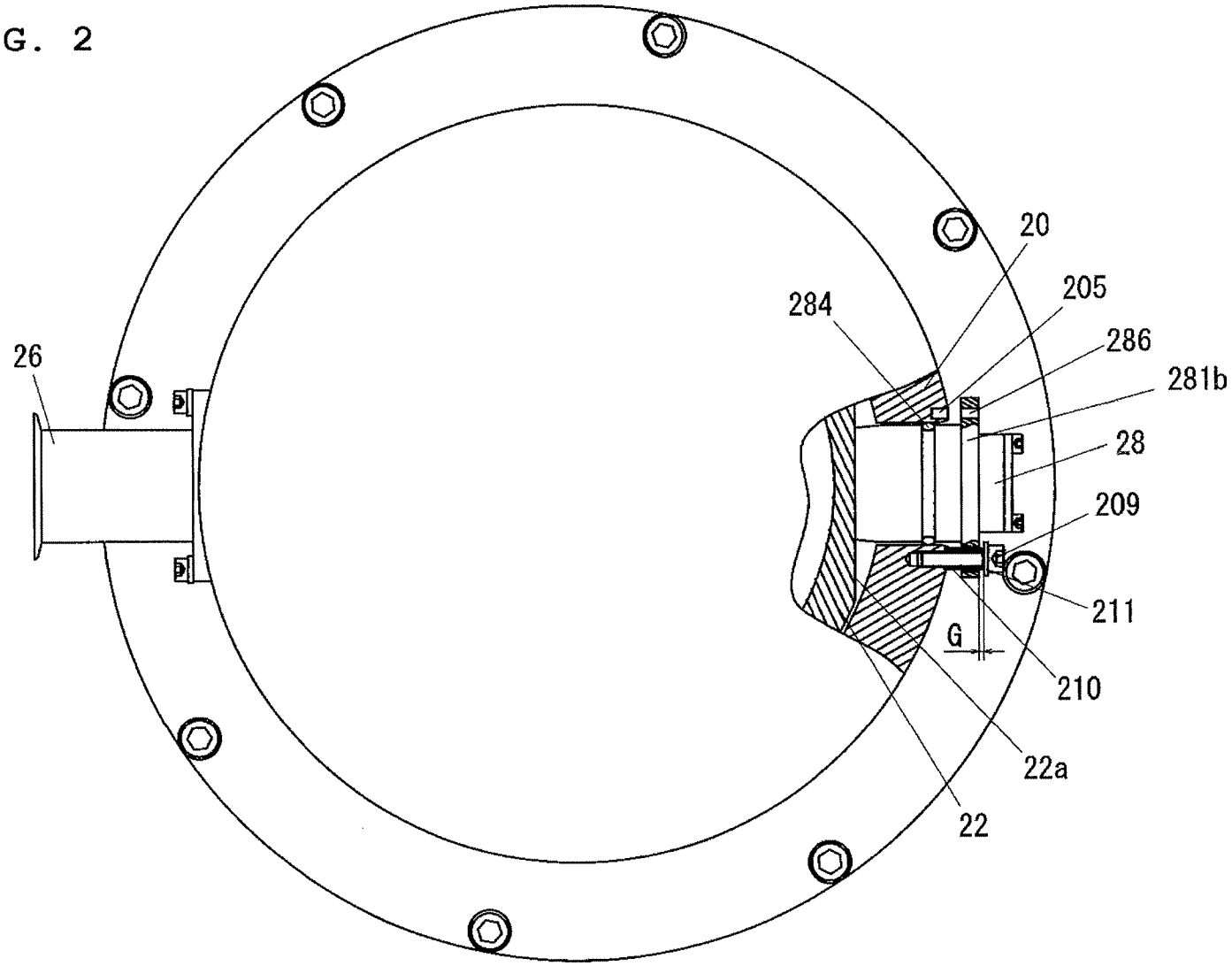
FIG. 2 is a bottom view of the turbo-molecular pump.

The base 20 is provided with a heater 27 for heating the base 20 and a temperature sensor 203 which detects the temperature of the base 20. The turbo-molecular pump 1 of the present embodiment can be used in a process involving the generation of a large amount of reaction products. A stator heating member 28 dedicated for heating the stator 22 is fixed to the outer peripheral surface of the lower part of the stator 22. FIG. 2 is a bottom view of the turbo-molecular pump 1 in which a part thereof is shown as a cut-out section. The stator heating member 28 penetrates the peripheral face of the base 20 from the inside through the outside thereof. Further, two or more stator heating members 28 may be provided.

Figure 3:
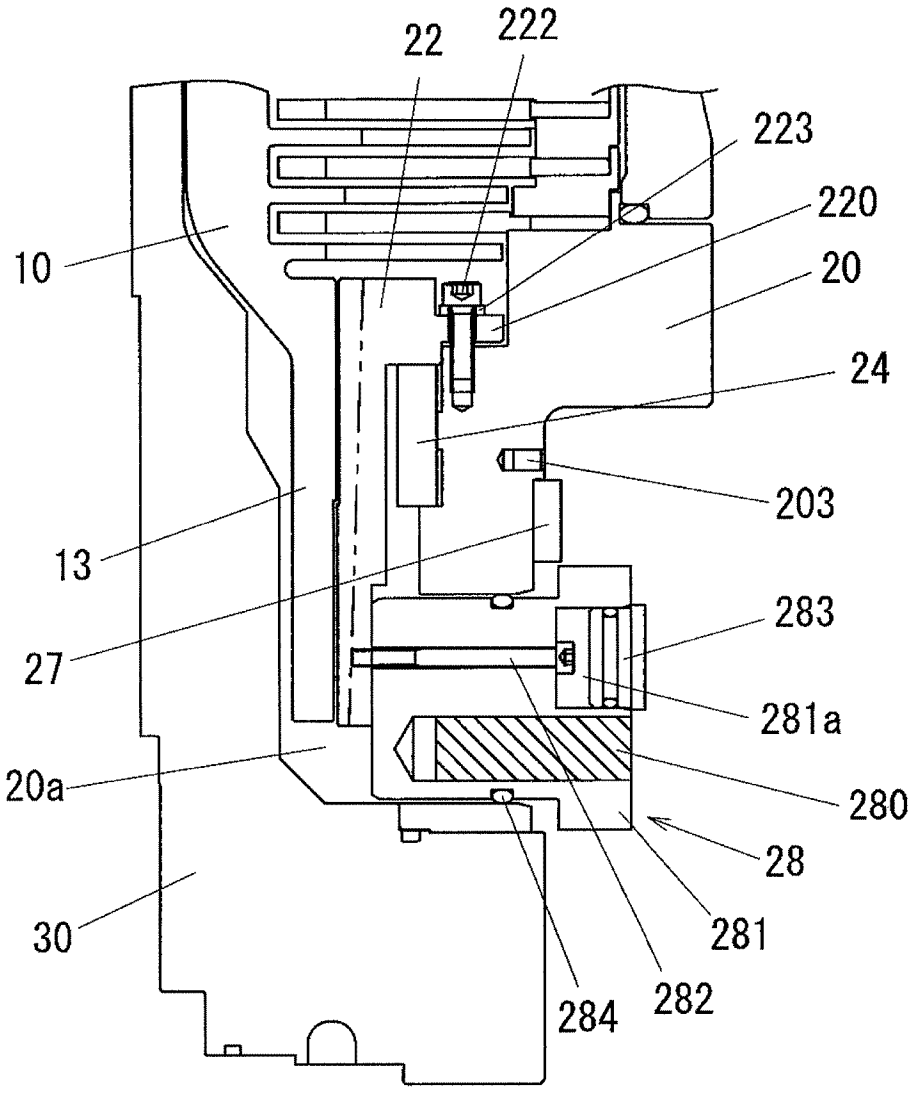
FIG. 3 is an enlarged view of a part of FIG. 1 in which a stator heating member 28 is disposed.

FIG. 3 is an enlarged view of a part of FIG. 1 in which the stator heating member 28 is disposed. As shown in FIG. 3, the stator heating member 28 includes a heater block 281 to which a heater 280 is attached. The heater block 281 is fixed to an outer peripheral surface of the stator 22 with a bolt 282. A sealing plug 283 is provided on a hole 281*a* on which the bolt 282 is disposed to seal the hole 281*a*. An axial seal 284 is disposed, as a vacuum seal, on a shaft section (the section penetrating the base 20) of the heater block 281. The axial seal 284 seals a gap between the shaft section of the heater block 281 which penetrates the base 20 and the base 20.

As shown in FIG. 2, a flat surface section 22*a* is formed on a part of the outer peripheral surface of the stator 22. A flat surface formed on the tip of the heater block 281 is brought into contact with the flat surface section 22*a*.

As shown in FIG. 3, the stator 22 is fixed to the base 20 with bolts 222. A heat insulation member 24 (e.g., a cylindrical heat insulation member) is arranged between the stator 22 and the base 20. The stator 22 is supported by the heat insulation member 24. A gap is formed between the bottom surface of the flange section 220 of the stator 22 and the upper surface of the base 20, and the flange section 220 is thus not in contact with the base 20.

A washer 223 of each of the bolts 222 is formed of a member having a smaller thermal conductivity than the base member and functions as a heat insulation member which suppresses heat transfer from the stator 22 to the base 20. For example, when an aluminum material is used in the base 20, a material having a smaller thermal conductivity than the aluminum material (e.g., a stainless material) is used in the washer 223. Although, in the present embodiment, the heat insulation member 24 as illustrated in FIG. 3 is interposed between the stator 22 and the base 20 to achieve heat insulation, the heat insulation structure is not limited to this structure. For example, a heat insulation member may be interposed between the flange section 220 of the stator 22 and the base 20.

As described above, the stator 22 is thermally in contact with the base 20 through substantially only the heat insulation member 24. Therefore, when a difference in temperature between the base 20 and the stator 22 is large, the amount of heat transfer from the stator 22 to the base 20 through the heat insulation member 24 becomes remarkably large. In view of this, the base 20 is heated by the heater 27 in accordance with the heat insulation property of the heat insulation member 24 so as to prevent a difference in temperature between the base 20 and the stator 22 from increasing to thereby suppress heat transfer from the stator 22 to the base 20 through the heat insulation member 24. Further, heating performed by the stator heating member 28 is controlled to maintain the temperature of the stator 22 at a high temperature (e.g., 100° C. or more) to thereby prevent accumulation of reaction products on the stator 22.

In the following, the accumulation prevention temperature is denoted by Ts. In a practical sense, the accumulation prevention temperature Ts includes a predetermined temperature range (Ts1 to Ts2). Thus, maintaining the stator 22 at the accumulation prevention temperature Ts means maintaining the stator 22 within the temperature range (Ts1 to Ts2). That is, the heater 280 is controlled to allow the temperature of the stator 22 to fall within the temperature range (Ts1 to Ts2).

As described above, the turbo-molecular pump 1 of the present embodiment is configured in such a manner that the stator heating member 28 directly heats the stator 22 and heat transfer from the stator 22 to the base 20 through the heat insulation member 24 is reduced as far as possible. Also in the stator heating member 28, the stator heating member 28 and the base 20 are maintained in a non-contact state to prevent heat transfer to the base 20. As shown in FIG. 3, vacuum seal between the stator heating member 28 and the base 20 is performed by the axial seal 284. When the stator heating member 28 is fixed to the outer peripheral surface (the flat surface section 22*a*) of the stator 22, centering as shown in FIGS. 4A and 4B is performed.

Figure 4A:
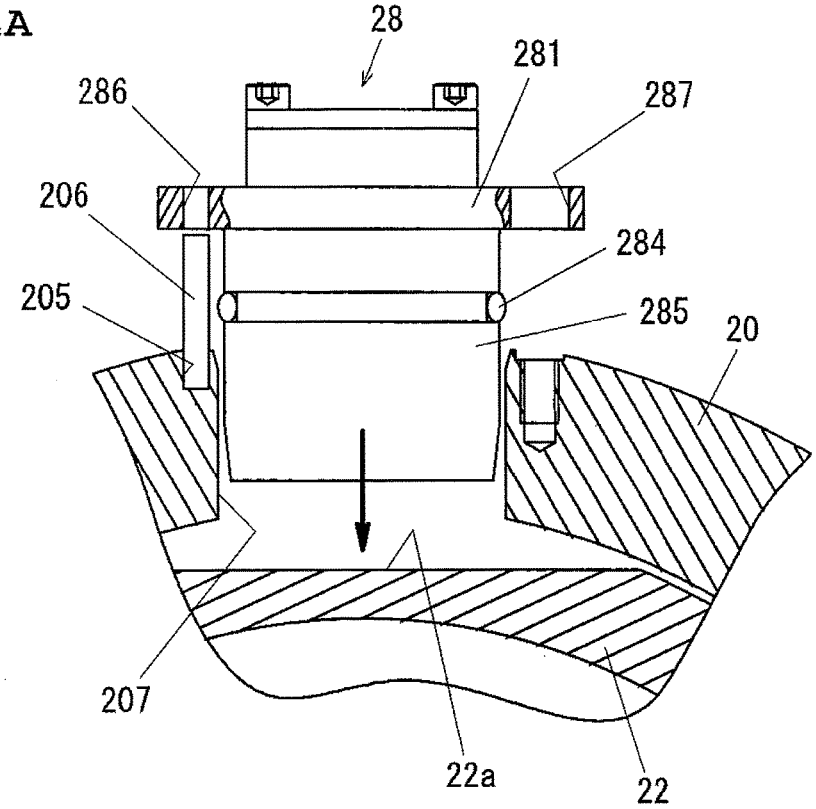
FIGS. 4A and 4B are diagrams illustrating a procedure of fixing the stator heating member 28 to a stator 22.
Figure 4B:
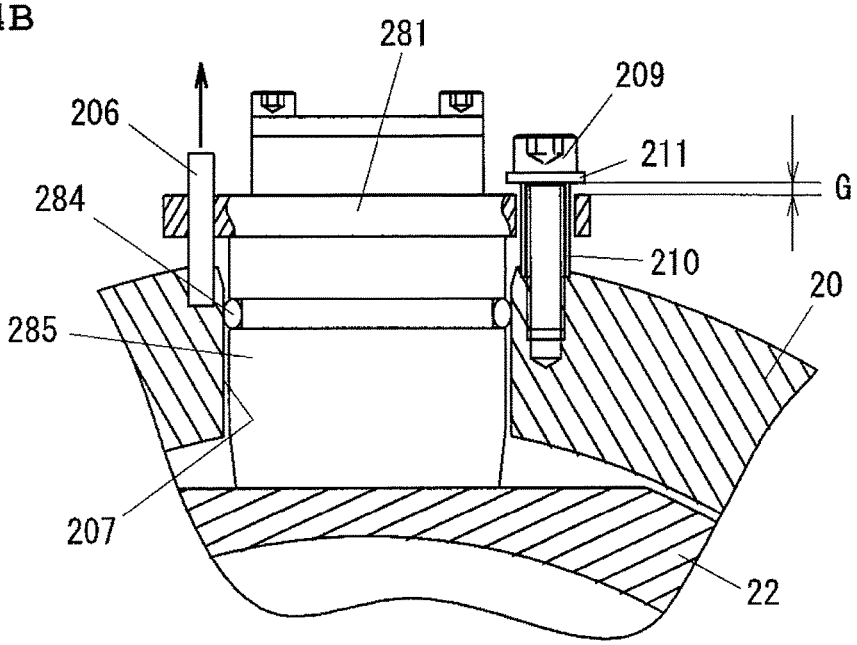

FIGS. 4A and 4B are diagrams illustrating a procedure of fixing the stator heating member 28 (the heater block 281) to the stator 22. In a step shown in FIG. 4A, pins 206 for centering are attached to pin holes 205 formed on the base 20. The pins 206 are used for performing centering between a shaft section 285 (the section on which the axial seal 284 is disposed) of the stator heating member 28 and a through hole 207 of the base 20 through which the shaft section 285 passes. The pin holes 205 are formed at at least two positions. Pin holes 286 for performing centering using the pins 206 are formed on the heater block 281. There is a loose fit relation between the pins 206 and the pin holes 205, 286.

As shown in FIG. 4A, the heater block 281 is inserted into the through hole 207 of the base 20 in a manner to allow the pins 206 to be inserted through the respective pin holes 286 to bring the tip of the heater block 281 into contact with the flat surface section 22*a* of the stator 22 as shown in FIG. 4B. At this point, since centering is performed using the pins 206, the axis of the shaft section 285 is substantially aligned with the axis of the through hole 207. Thus, the shaft section 285 and the through hole 207 are in a non-contact state. Further, the dimension of a gap between the shaft section 285 and the through hole 207 is substantially constant throughout the entire circumference of the shaft section 285.

Then, the heater block 281 is fixed to the stator 22 with the bolt 282 illustrated in FIG. 3. Further, a bolt 209 is fixed to the base 20 in a manner to pass through a through hole 287 formed on a flange section of the heater block 281. A washer 211 and a tubular spacer 210 are arranged between the bolt 209 and the base 20. The length of the spacer 210 is set in such a manner that a predetermined gap G is formed between the washer 211 and the heater block 281. The diameter of the through hole 287 is set to be larger than the outer diameter of the spacer 210 so as to prevent the spacer 210 from coming into contact with the heater block 281. At last, the pins 206 are removed to finish an operation of fixing the heater block 281 to the stator 22. The pins 206 are removed in order to prevent heat from escaping from the heater block 281 to the base 20 through the pins 206.

In this manner, the centering between the shaft section 285 of the heater block 281 and the through hole 207 of the base 20 is performed using the pins 206 for centering to be removed eventually. Thus, the heater block 281 and the base 20 can be reliably brought into a non-contact state. Further, the axial seal 284 is used, and the heater block 281 is not fixed to the base 20. Thus, the heater block 281 can freely move in the pump radial direction. For example, when the stator 22 becomes a high-temperature state and thereby thermally expands, the heater block 281 moves outward in the radial direction along with the expansion of the stator 22.

In the conventional vacuum pump disclosed in JP 09-072293 A, the heating member fixed to the stator is fixed to the base with a heat insulation spacer interposed therebetween. Thus, although the stator can thermally expand outward in the radial direction in a part to which the heating member is not fixed, thermal expansion of the stator is blocked by the heating member in the part to which the heating member is fixed. Therefore, an unnatural stress is generated in the stator.

Also in the vacuum pump of JP 09-072293 A, the rotor rotates at high speed on the inner peripheral side of the stator with a tiny gap therebetween as with the present embodiment. However, when the temperature of the stator is increased to prevent adhesion of reaction products, the temperature of the rotor also increases along with the increase in the temperature of the stator and the rotor thereby thermally expands outward. In a conventional configuration in which the heating member is fixed to the base, the stator (the heating target member) cannot thermally expand outward in the part of the stator in which the heating member is disposed. Thus, the gap between the rotor and the stator becomes smaller, which may cause contact between the rotor and the stator.

On the other hand, in the vacuum pump of the present embodiment, the heater block 281 can freely move in the pump radial direction along with thermal expansion of the stator 22 as described above. Therefore, it is possible to prevent the generation of an unnatural stress in the stator 22 and a decrease in the size of the gap between the stator 22 and the rotor cylindrical section 13 in the part to which the stator heating member 28 is fixed caused by thermal expansion of the stator 22.

In the present embodiment, the stator heating member 28 (the heater block 281) is not fixed to the base 20. Thus, the bolt 209 is provided to ensure safety when the rotor is broken. For example, when the stator 22 is also broken along with the breakage of the rotor, the stator heating member 28 may jump out of the base 20. Even in such a case, the bolt 209 prevents the stator heating member 28 from jumping out of the base 20 in the present embodiment. Further, even when the stator 22 or the heater block 281 thermally expands, the formed gap G prevents contact between the bolt 209 and the heater block 281.

Modification of Stator Heating Member 28

Figure 7A:
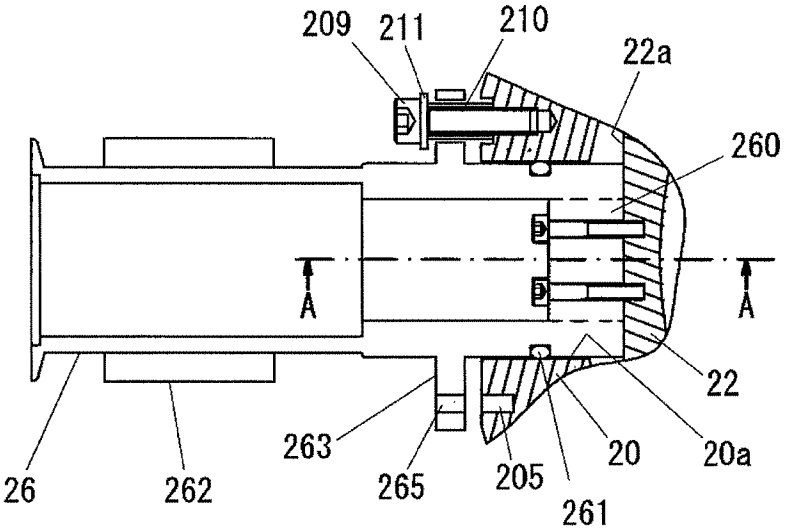
FIGS. 7A and 7B are diagrams showing an exhaust pipe 26 which also serves as a heating member.
Figure 7B:
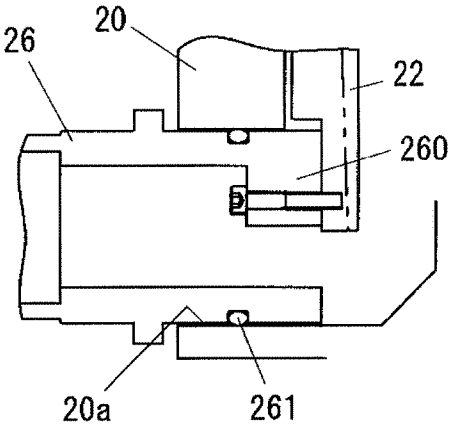

As shown in FIG. 2, in the present embodiment, the stator heating member 28 dedicated for heating is provided as means for heating the stator 22. Alternatively, the exhaust pipe 26 may be used as a heating member as shown in FIGS. 7A and 7B. FIGS. 7A and 7B are cross-sectional views of the exhaust pipe 26 in a modification. FIG. 7A is a cross-sectional view viewed from the side of a pump suction port. FIG. 7B is a cross-sectional view taken along line A-A of FIG. 7A.

A part of the exhaust pipe 26, the part facing the base 20, penetrates the base 20. A fixation section 260 to be fixed to the stator 22 is formed on the tip of the base side part of the exhaust pipe 26. The fixation section 260 is fixed to the flat surface section 22*a* of the stator 22 with a bolt. An axial seal 261 as a vacuum seal is disposed on the base penetrating part of the exhaust pipe 26. Further, a flange section 263 is formed on the exhaust pipe 26. As with the stator heating member 28 shown in FIGS. 4A and 4B, pin holes 265 for positioning are formed on the flange section 263. Positioning pins are engaged with the pin holes 265 and the pin holes 205 formed on the base 20 to perform centering between the exhaust pipe 26 and a base side through hole into which the exhaust pipe 26 is inserted.

Further, as with the stator heating member 28, a bolt 209 for restriction is disposed in order to prevent an adverse effect on a back pump when the exhaust pipe 26 jumps out of the base 20 when the stator 22 is broken. A washer 211 and a spacer 210 are arranged on the bolt 209.

Next, a fixing structure of the stator 22 will be described. As with the stator heating member 28, heat conduction from the stator 22 to the base 20 is made small as far as possible.

Figure 5:
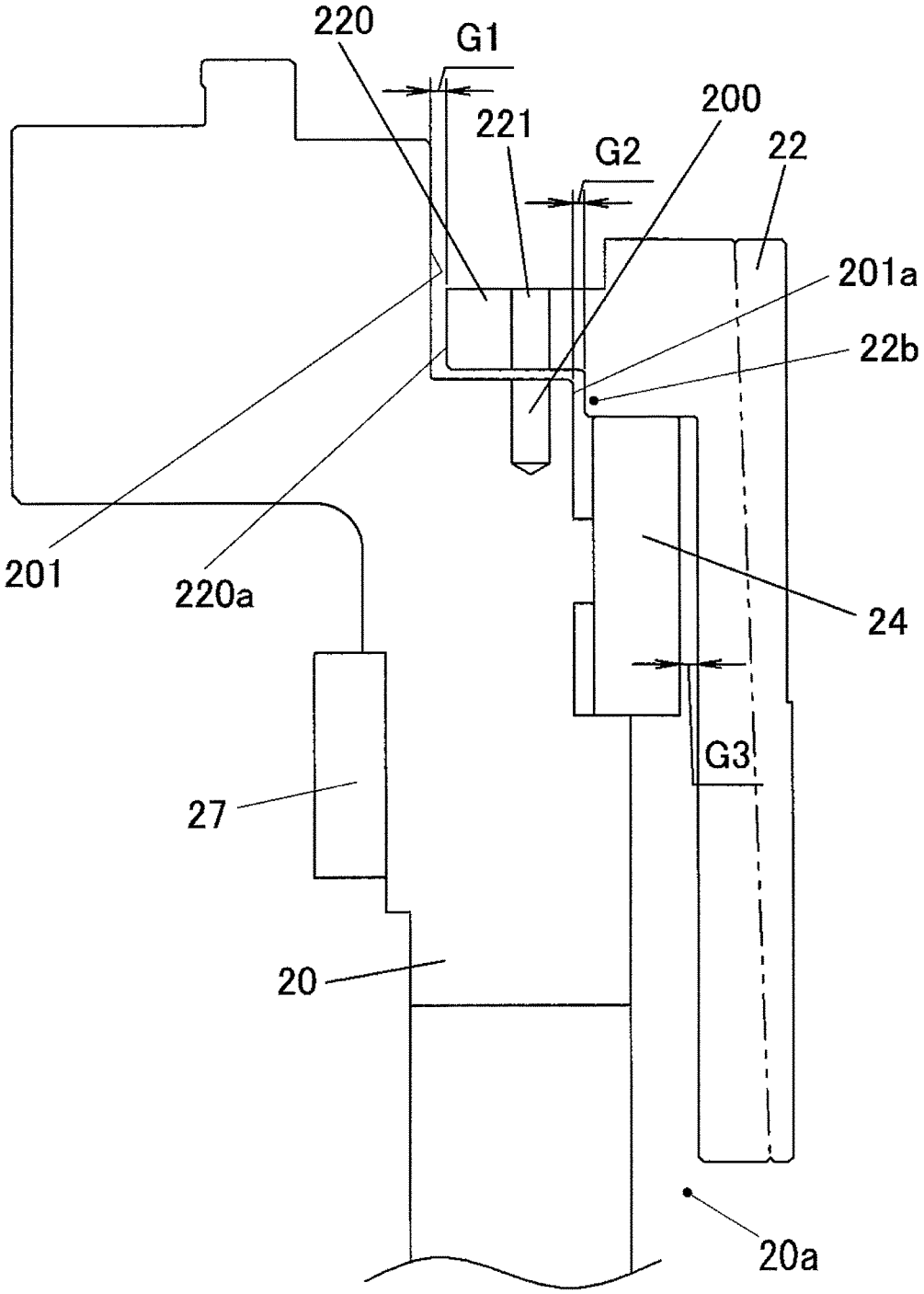
FIG. 5 is an enlarged view of a fixing part between the stator 22 and a base 20 shown on the left side of FIG. 1.

FIG. 5 is an enlarged view of a fixing part between the stator 22 and the base 20 shown on the left side of FIG. 1. As described above with reference to FIGS. 4A and 4B, centering between the heater block 281 and the through hole 207 of the base 20 is performed using the pins to be removed eventually. In this state, the heater block 281 is fixed to the outer peripheral surface of the stator 22 with the bolt. In the same manner, also in fixing between the stator 22 and the base 20, centering is performed using pins to be removed eventually, and the stator 22 is fixed to the base 20 with the bolts 222.

As described above, the heat insulation member 24 is arranged between the stator 22 and the base 20. Thus, a gap is formed between the flange section 220 of the stator 22 and the upper surface of the base 20, and the bottom surface of the flange section 220 is thus not in contact with the base 20. Further, gaps G1 to G3 (the dimensions of the gaps are also denoted by G1, G2, and G3) as illustrated in FIG. 5 are formed around the outer peripheral surface in the radial direction of the stator 22.

Further, two or more pin holes 200 are formed on the base 20. Pin holes 221 are formed on the stator 22 at positions facing the respective pin holes 200 of the base 20. When the stator 22 is fixed to the base 20, positioning pins are first attached to the respective pin holes 200 of the base 20. Then, the stator 22 is then placed on the base 20 (actually placed on the heat insulation member 24) in a manner to allow the positioning pins to be engaged with the respective pin holes 221. Then, the stator 22 is fixed to the base 20 with the bolts 222 as shown in FIG. 3. Upon completion of the fixing of the stator 22 to the base 20 with the bolts, the positioning pins are removed from the pin holes 200, 221.

Next, the gaps G1 to G3 will be described. The gap G1 is a gap formed between an outer peripheral surface 220*a* of the flange section 220 of the stator 22 and an inner peripheral surface 201 of the base 20. The gap G2 is a gap formed between the outer peripheral surface of a step 22*b* formed on the bottom surface of the flange section 220 and an inner peripheral surface 201*a* of the base 20. The gap G3 is a gap formed between the outer peripheral surface of a cylindrical section of the stator 22 and the inner peripheral surface of the heat insulation member 24. When the stator 22 is heated to have a high temperature (e.g., 100° C. or more), the stator 22 thermally expands in the radial direction, which makes the gaps G1 to G3 smaller.

A conventional turbo-molecular pump typically has a fitting structure between the outer peripheral surface 220*a* of the flange section 220 of the stator 22 and the inner peripheral surface 201 of the base 20 to perform positioning (centering) of the stator 22 with respect to the base 20. The positioning is performed in order to concentrically align the axis of the rotor cylindrical section 13 with the axis of the stator 22 so that a gap between the rotor cylindrical section 13 and the stator 22 becomes uniform. The gap between the rotor cylindrical section 13 and the stator 22 is approximately 1 mm. Thus, a clearance of the fitting between the outer peripheral surface 220*a* and the inner peripheral surface 201, that is, the dimension of the gap G1 of FIG. 5 is approximately 0.1 mm. Thus, when the outer diameter dimension of the flange section 220 increases due to thermal expansion of the stator 22, the outer peripheral surface 220*a* of the flange section 220 may come into contact with the inner peripheral surface 201 of the base 20. In such a case, heat of the stator 22 escapes to the base 20.

On the other hand, in the present embodiment, the stator 22 is positioned with respect to the base 20 using the positioning pins. Thus, a fitting structure is not required between the outer peripheral surface 220*a* and the inner peripheral surface 201, and the gap G1 can be set to be sufficiently large. Therefore, it is possible to reliably prevent the outer peripheral surface 220*a* of the flange section 220 from coming into contact with the inner peripheral surface 201 of the base 20 when the stator 22 thermally expands.

When the bolt 222 which fixes the stator 22 is loosened, the stator 22 may be laterally shifted in the radial direction with respect to the base 20. In the present embodiment, the dimension of the gap G1 is set to be sufficiently large to prevent contact caused by thermal expansion as described above. Thus, the gap G2 which is smaller than the gap G1 is provided to prevent contact between the stator 22 and the rotor cylindrical section 13 when the stator 22 is laterally shifted. When the gap between the rotor cylindrical section 13 and the stator 22 is denoted by G0, the gap G2 is set to satisfy "G0>G2" and also to be larger than a change in the radial dimension of the stator 22 caused by thermal expansion. Further, the gap G3 between the outer peripheral surface of the cylindrical section of the stator 22 and the inner peripheral surface of the heat insulation member 24 is set to be larger than G2. With such a configuration, even when the stator 22 is laterally shifted, the step 22*b* of the stator 22 abuts on the inner peripheral surface 201*a* of the base 20 to prevent contact between the stator 22 and the rotor cylindrical section 13.

Figure 8:
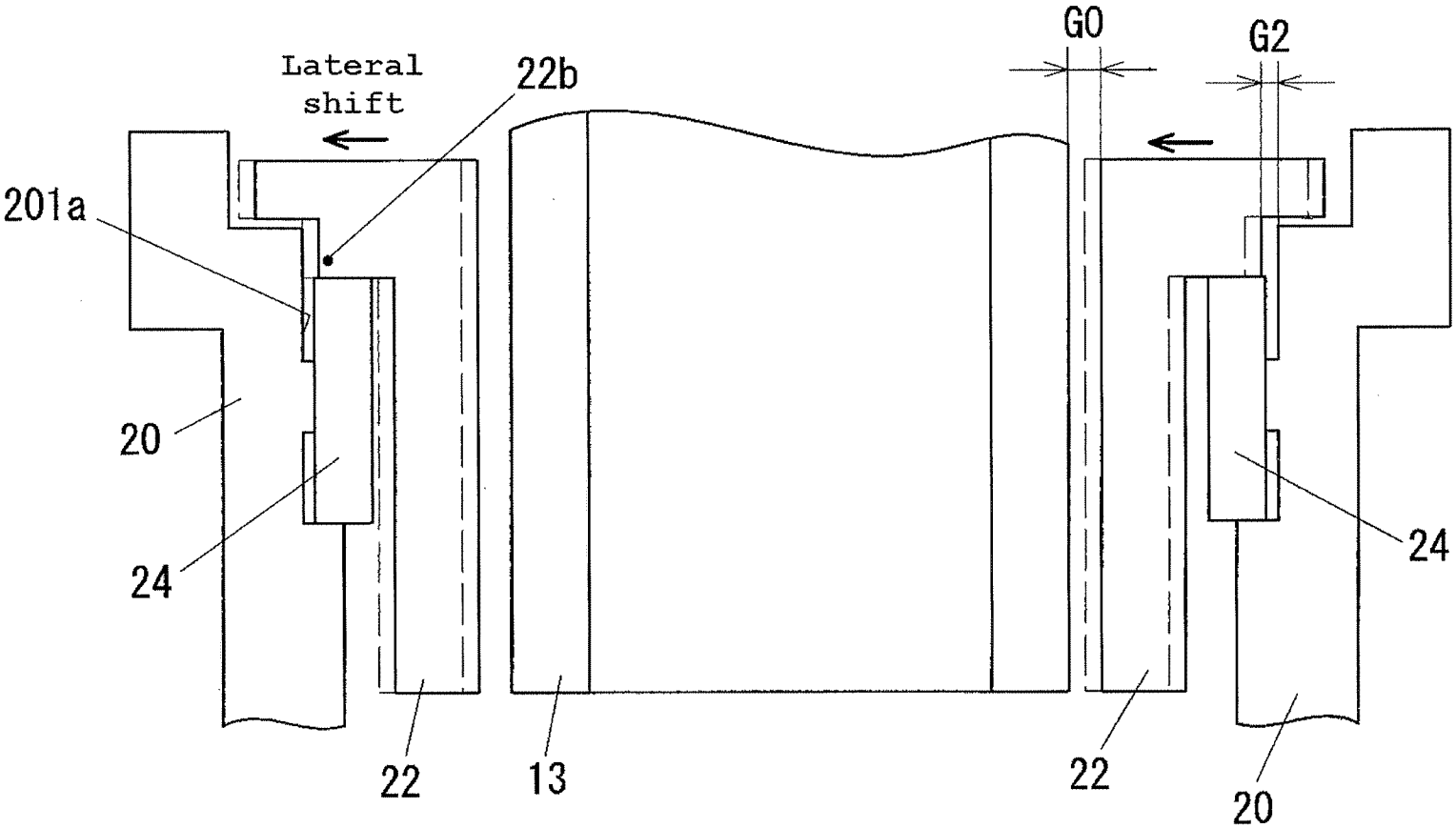
FIG. 8 is a diagram illustrating an effect of the gap G2.
Figure 9B:
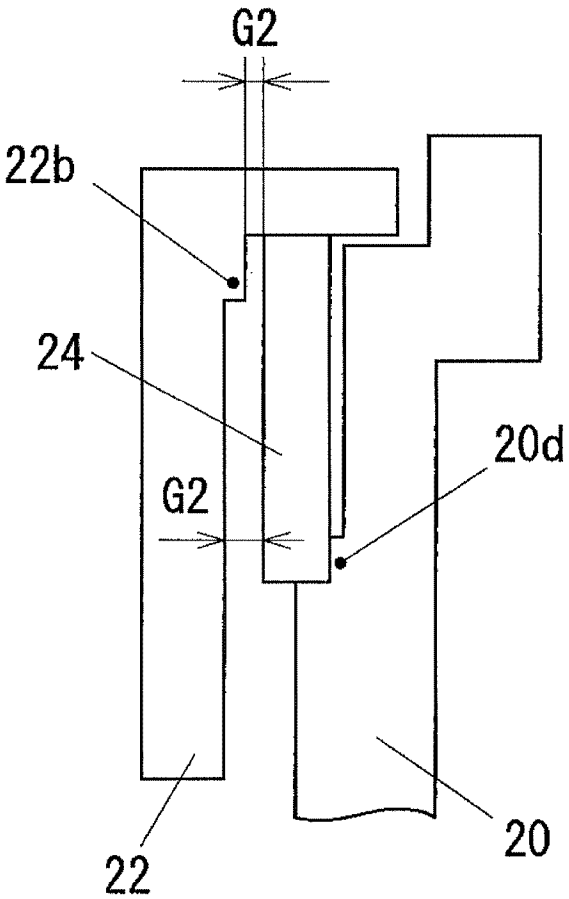
FIGS. 9A and 9B are diagrams showing a case in which the gap G2 is formed between the stator 22 and a heat insulation member 24.
Figure 9A:
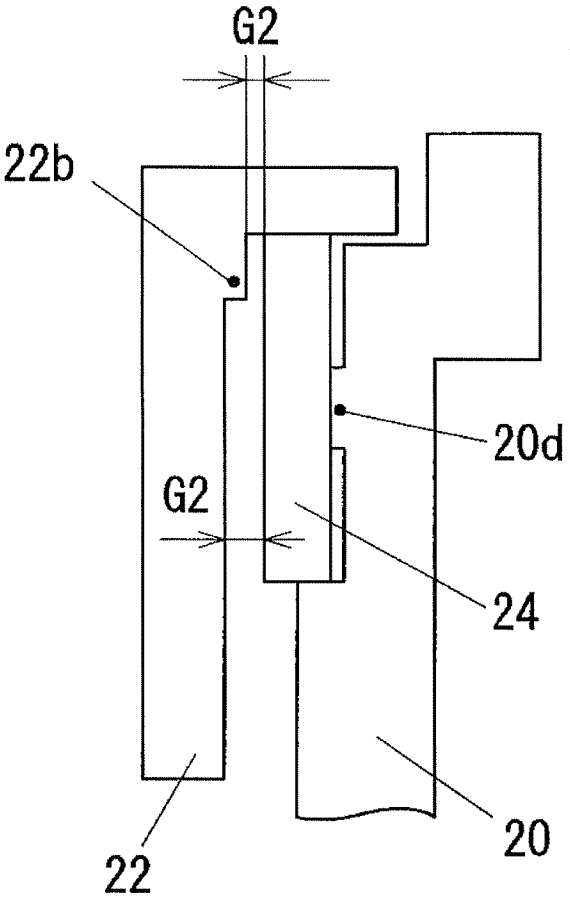

In the above embodiment, the gap G2 (>G0, G1, and G3) between the step 22*b* of the stator 22 and the inner peripheral surface 201*a* of the base 20 prevents contact between the stator 22 and the rotor cylindrical section 13 when the stator 22 is laterally shifted as shown in FIG. 8. Configurations as shown in FIGS. 9A and 9B may be employed as such a contact prevention structure. In the example shown in FIG. 9A, the step 22*b* of the stator 22 faces the inner peripheral surface of the heat insulation member 24. The dimension of a gap between the step 22*b* and the heat insulation member 24 is set to G2. Thus, even when bolt fixation is loosened and the stator 22 is thereby shifted in the axial direction, the step 22*b* abuts on the heat insulation member 24, thereby making it possible to prevent contact between the stator 22 and the rotor cylindrical section 13.

The heat insulation member 24 is formed of a material having a smaller thermal conductivity than the stator 22 and the base 20. For example, when the stator 22 and the base 20 are formed of an aluminum alloy and the heat insulation member 24 is formed of a stainless material, a gap between a projection 20*d* (having a fitting structure with respect to the heat insulation member 24) of the base 20 and the outer peripheral surface of the heat insulation member 24 becomes larger due to thermal expansion caused by temperature rise, and, on the other hand, the gap G2 becomes smaller. Thus, even when the gap between the projection 20*d* and the heat insulation member 24 becomes larger due to thermal expansion and the heat insulation member 24 placed on the stator 22 is thereby laterally shifted, the gap G2 becomes smaller as described above to reduce the amount of lateral shift of the stator 22 with respect to the heat insulation member 24. Therefore, it is possible to reduce the amount of lateral shift of the stator 22 to the same degree as the gap G2 before the thermal expansion. As a result, it is possible to prevent contact between the stator 22 and the rotor cylindrical section 13. As shown in FIG. 9B, the projection 20*d* of the base 20 which has a fitting structure with respect to the outer peripheral surface of the heat insulation member 24 may be located on the lower end part of the heat insulation member 24.

Figure 6:
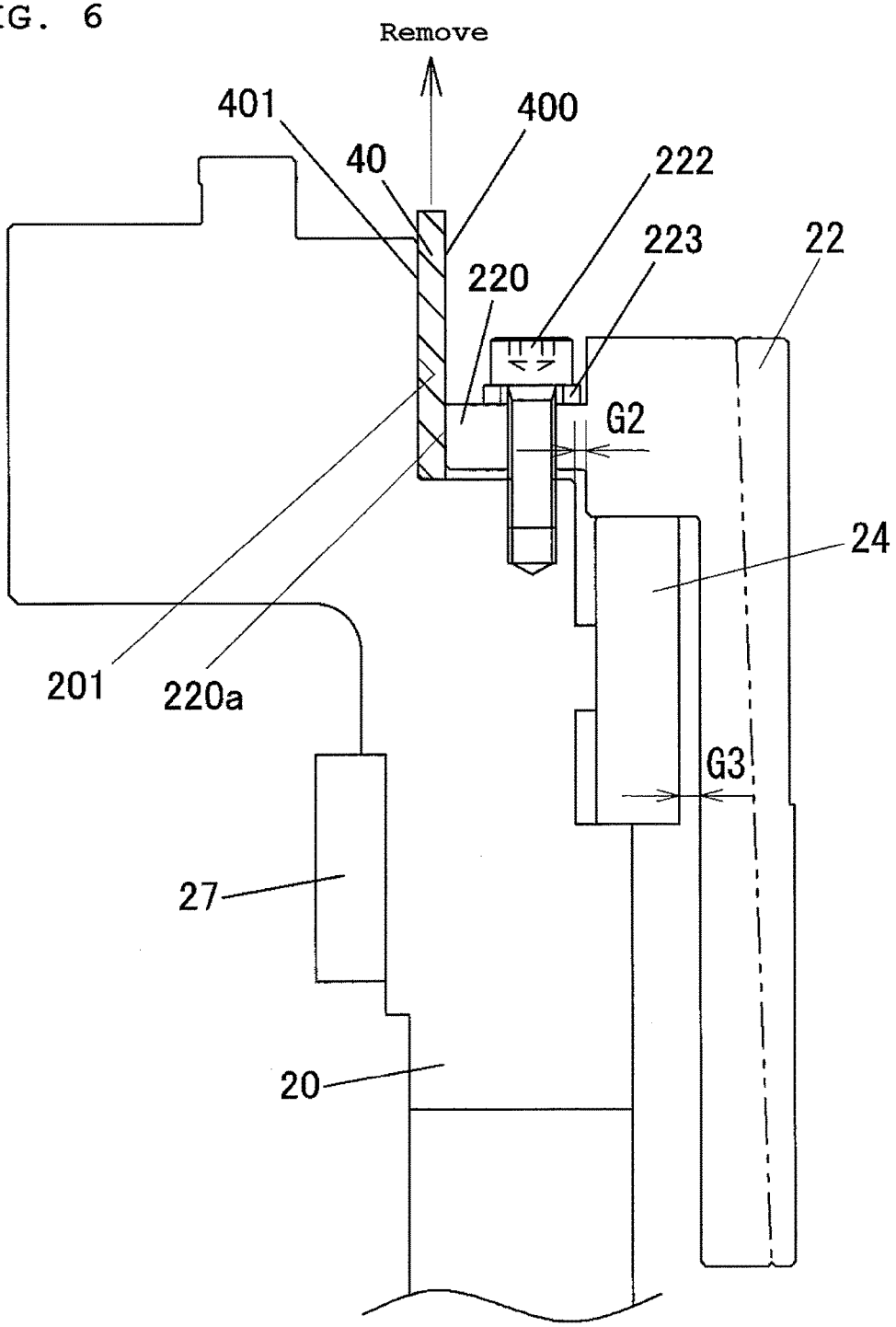
FIG. 6 is a diagram illustrating a positioning member 40.

In the example shown in FIG. 5, the positioning pins are used to position the stator 22 with respect to the base 20. Alternatively, a positioning member 40 other than a pin may be used as shown in FIG. 6. In the example shown in FIG. 6, the positioning member 40 is used to perform positioning between the inner peripheral surface 201 of the base 20 and the outer peripheral surface 220*a* of the flange section 220 of the stator 22.

There is a fitting relation (loose fit) between an outer peripheral surface 401 of the positioning member 40 and the inner peripheral surface 201 of the base 20. First, the positioning member 40 is arranged on the base 20. Then, the stator 22 is arranged on the inner peripheral side of the positioning member 40. There is a fitting relation (loose fit) between the outer peripheral surface 220*a* of the flange section 220 of the stator 22 and an inner peripheral surface 400 of the positioning member 40. Arranging the stator 22 on the inner peripheral side of the positioning member 40 allows the stator 22 to be concentrically positioned with respect to the base 20. Then, the stator 22 is fixed to the base 20 with bolts 222. Then, the positioning member 40 is removed to finish an operation of fixing the stator 22 to the base 20.

As described above, the vacuum pump of the present embodiment is provided with the rotor cylindrical section 13, the cylindrical stator 22 which discharges gas in cooperation with the rotor cylindrical section 13, the base 20 which houses at least a part of the stator 22 and has the through hole 207 formed at a position facing the outer periphery of the stator 22, the stator heating member 28 which passes through the through hole 207 from the atmosphere side to the vacuum side to have thermal contact with the outer peripheral surface of the stator 22 to heat the stator 22, and the axial seal 284 which vacuum-seals the gap between the through hole 207 and the stator heating member 28 (the shaft section 285). Thus, even when the stator 22 is deformed in the radial direction due to thermal expansion, the heater block 281 can freely move in the pump radial direction along with the deformation. As a result, it is possible to prevent an unnatural stress from being generated in the stator 22 and the gap between the stator 22 and the rotor cylindrical section 13 from becoming smaller, and thereby improve the reliability of the vacuum pump.

Preferably, the stator heating member 28 is arranged with a gap with respect to the through hole 207 of the base 20 and fixed to the stator 22 in a concentric state with the through hole 207. Thus, a uniform gap is formed between the through hole 207 and the stator heating member 28, thereby making it possible to prevent the stator heating member 28 from coming into contact with the base 20 by thermal expansion.

Preferably, the vacuum pump is further provided with a restriction member such as the bolt 209 which restricts movement of the stator heating member 28 toward the atmospheric side, the stator heating member 28 passing through the through hole 207. Accordingly, it is possible to prevent the stator heating member 28 from jumping out of the base 20 due to, for example, the breakage of the rotor. Such a restriction member is not limited to the bolt 209, and may have various forms (e.g., a claw-like member attached to the base 20).

As the heating member which heats the stator 22, not only the dedicated stator heating member 28, but also, for example, the exhaust pipe 26 may be used as shown in FIGS. 7A and 7B. The exhaust pipe 26 is a tubular member which has one end fixed to the outer peripheral surface of the stator 22 and the other end passing through the through hole 20*a* to be exposed to the atmospheric side. The heater 262 is attached to the exhaust pipe 26. Further, the axial seal 261 which vacuum-seals a gap between the through hole 20*a* and the exhaust pipe 26 is disposed on the exhaust pipe 26.

The above embodiment and the modifications may be used independently or in combination to achieve the effects of the embodiment and the modifications independently or in a synergetic manner. Further, the present invention is not limited at all to the above embodiment unless the features of the present invention are impaired. For example, in the above embodiment, the stator heating member 28 directly heats the stator 22 so that the stator temperature becomes higher than the base temperature. Alternatively, the present invention can also be applied to a case in which the stator temperature becomes higher than the base temperature by heat generation of gas during discharge of gas. The present invention can be applied not only to a turbo-molecular pump, but also to a vacuum pump which is provided with a cylindrical rotor and a cylindrical stator.

What is claimed is:

1. A vacuum pump comprising:

a cylindrical rotor;

a cylindrical stator which discharges gas in cooperation with the rotor;

a base housing at least a part of the stator and having a through hole formed at a position facing an outer periphery of the stator;

a heating member passing through the through hole from an atmosphere side to a vacuum side to have thermal contact with an outer peripheral surface of the stator to heat the stator, and disposed so as to have a gap between the through hole and the heating member; and an axial seal member which vacuum-seals the gap between the through hole and the heating member, with the gap extending axially from the axial seal member.

2. The vacuum pump according to claim 1, wherein the heating member is fixed to the stator in a concentric state with the through hole.

3. The vacuum pump according to claim 2, wherein pin holes are formed on the heating member and the base, and positioning pins for achieving the concentric state are inserted into the pin holes.

4. The vacuum pump according to claim 2, further comprising a restriction member restricting movement of the heating member toward the atmospheric side when the fixing is released.

5. The vacuum pump according to claim 1, wherein the heating member includes an exhaust pipe discharging sucked gas therethrough and a heater attached to the exhaust pipe, the exhaust pipe passes through the through hole of the base, and has one end having thermal contact with the outer peripheral surface of the stator and the other end exposed to the atmospheric side, and the axial seal member vacuum-seals a gap between the through hole and the exhaust pipe.

6. The vacuum pump according to claim 1, wherein when the cylindrical stator is deformed in the radial direction due to thermal expansion, the heating member can freely move in the pump radial direction along with the deformation.

* * * * *